US009617661B2

(12) United States Patent
Custodero et al.

(10) Patent No.: US 9,617,661 B2
(45) Date of Patent: Apr. 11, 2017

(54) METHOD OF MANUFACTURING A TWO-LAYER METAL CORD RUBBERIZED IN SITU USING AN UNSATURATED THERMOPLASTIC ELASTOMER

(71) Applicants: COMPAGNIE GENERALE DES ETABLISSEMENTS MICHELIN, Clermont-Ferrand (FR); Michelin Recherche et Technique S.A., Granges-Paccot (CH)

(72) Inventors: Emmanuel Custodero, Clermont-Ferrand (FR); Sébastien Rigo, Clermont-Ferrand (FR); Jérémy Toussain, Clermont-Ferrand (FR)

(73) Assignees: Compagnie Generale Des Etablissements Michelin, Clermont-Ferrand (FR); Michelin Recherche Et Technique S.A., Granges-Paccot (CH)

( * ) Notice: Subject to any disclaimer, the term of this patent is extended or adjusted under 35 U.S.C. 154(b) by 309 days.

(21) Appl. No.: 14/358,089

(22) PCT Filed: Nov. 14, 2012

(86) PCT No.: PCT/EP2012/072541
§ 371 (c)(1),
(2) Date: May 14, 2014

(87) PCT Pub. No.: WO2013/075985
PCT Pub. Date: May 30, 2013

(65) Prior Publication Data

US 2014/0290204 A1 Oct. 2, 2014

(30) Foreign Application Priority Data

Nov. 23, 2011 (FR) ..... 11 60672

(51) Int. Cl.
*D02G 3/48* (2006.01)
*D07B 1/06* (2006.01)
(Continued)

(52) U.S. Cl.
CPC ..... *D02G 3/48* (2013.01); *D07B 1/062* (2013.01); *D07B 1/0626* (2013.01); *D07B 7/145* (2013.01);
(Continued)

(58) Field of Classification Search
CPC ..... D02G 3/48; D07B 1/062; D07B 1/0626; D07B 7/145
See application file for complete search history.

(56) References Cited

U.S. PATENT DOCUMENTS 6,579,940 B1 6/2003 Dove ..... 525/98
8,166,741 B2 5/2012 Barguet et al. ..... 57/216
(Continued)

FOREIGN PATENT DOCUMENTS

EP 1 186 699 A2 3/2002
WO WO 2006/013077 A1 2/2006
(Continued)

OTHER PUBLICATIONS

U.S. Appl. No. 14/358,126, filed Nov. 14, 2012, T. Pottier.

*Primary Examiner* — Shaun R Hurley
(74) *Attorney, Agent, or Firm* — Fitzpatrick, Cella, Harper & Scinto

(57) ABSTRACT

A method of manufacturing a metal cord with two concentric layers of wires is provided. The cord includes an internal layer of M wires, M having a value from 1 to 4, and an external layer of N wires. The cord is rubberized from within in situ. That is, during manufacture of the cord, the cord is rubberized from inside. According to the method, the internal layer is sheathed with rubber or a rubber compound by
(Continued)

passing the internal layer through an extrusion head, and the N wires of the external layer are assembled around the sheathed internal layer to form a two-layer cord rubberized from the inside. The rubber is an unsaturated thermoplastic elastomer that is extruded in a molten state, and preferably is a thermoplastic styrene (TPS) type of thermoplastic elastomer, such as an SBS or an SIS block copolymer, for example.

10 Claims, 2 Drawing Sheets

(51) Int. Cl.
*D07B 7/14* (2006.01)
*D07B 5/12* (2006.01)

(52) U.S. Cl.
CPC ..... *D07B 5/12* (2013.01); *D07B 2201/203* (2013.01); *D07B 2201/2028* (2013.01); *D07B 2201/2032* (2013.01); *D07B 2201/2046* (2013.01); *D07B 2201/2059* (2013.01); *D07B 2201/2061* (2013.01); *D07B 2201/2062* (2013.01); *D07B 2201/2065* (2013.01); *D07B 2201/2082* (2013.01); *D07B 2205/2003* (2013.01); *D07B 2205/2017* (2013.01); *D07B 2205/2082* (2013.01); *D07B 2207/205* (2013.01); *D07B 2207/4072* (2013.01); *D07B 2501/2046* (2013.01)

(56) References Cited

U.S. PATENT DOCUMENTS

| | | | | |
|---|---|---|---|---|
| 8,191,348 | B2 | 6/2012 | Barguet et al. | 57/223 |
| 8,245,490 | B2 | 8/2012 | Barguet et al. | 57/217 |
| 8,627,696 | B2 | 1/2014 | Pottier et al. | 72/64 |
| 2006/0237110 | A1 | 10/2006 | Barguet et al. | 352/451 |
| 2008/0115874 | A1* | 5/2008 | Thielen | B60C 1/00 152/541 |
| 2011/0011486 | A1* | 1/2011 | Pottier | D07B 5/12 140/149 |
| 2011/0017376 | A1 | 1/2011 | Pottier et al. | 152/451 |
| 2011/0198008 | A1 | 8/2011 | Pottier et al. | 152/451 |
| 2011/0315296 | A1 | 12/2011 | Cogne et al. | 152/451 |
| 2012/0000590 | A1 | 1/2012 | Cogne et al. | 152/564 |
| 2012/0125506 | A1 | 5/2012 | Custodero et al. | 152/451 |
| 2012/0174557 | A1 | 7/2012 | Boisseau et al. | 57/213 |
| 2013/0220505 | A1 | 8/2013 | Pottier et al. | 152/451 |
| 2013/0220506 | A1 | 8/2013 | Pottier et al. | 152/451 |
| 2013/0227924 | A1 | 9/2013 | Custodero et al. | 57/3 |
| 2013/0232936 | A1 | 9/2013 | Custodero et al. | 57/7 |
| 2014/0044964 | A1 | 2/2014 | Abad et al. | 428/378 |
| 2014/0045983 | A1 | 2/2014 | Abad et al. | 524/440 |

FOREIGN PATENT DOCUMENTS

| | | | |
|---|---|---|---|
| WO | WO 2007/090603 | A1 | 8/2007 |
| WO | WO 2009/083212 | A1 | 7/2009 |
| WO | WO 2009/083213 | A1 | 7/2009 |
| WO | WO 2010/012411 | A1 | 2/2010 |
| WO | WO 2010/072463 | A1 | 7/2010 |
| WO | WO 2010/072464 | A1 | 7/2010 |
| WO | WO 2010/105975 | A1 | 9/2010 |
| WO | WO 2011/000963 | A2 | 1/2011 |
| WO | WO 2011/144469 | A1 | 11/2011 |
| WO | WO 2011/144471 | A1 | 11/2011 |
| WO | WO 2011/144472 | A1 | 11/2011 |
| WO | WO 2011/144473 | A1 | 11/2011 |

* cited by examiner

METHOD OF MANUFACTURING A TWO-LAYER METAL CORD RUBBERIZED IN SITU USING AN UNSATURATED THERMOPLASTIC ELASTOMER

FIELD OF THE INVENTION

The present invention relates to methods and devices for manufacturing metal cords with two concentric layers of wires which can be used notably for reinforcing articles made of rubber, particularly tyres.

It relates more particularly to the methods and devices for manufacturing metal cords of the type "rubberized in situ", i.e. rubberized from the inside, during their actual manufacture, with rubber or a rubber compound with a view to improving their corrosion resistance and, therefore, their endurance notably in carcass or crown reinforcements for tyres for industrial vehicles.

RELATED ART

A radial tyre comprises in the known way a tread, two inextensible beads, two sidewalls connecting the beads to the tread and a belt arranged circumferentially between the carcass reinforcement and the tread. The carcass reinforcement is made up of at least one ply (or "layer") of rubber which is reinforced with reinforcing elements (or "reinforcers") such as cords or monofilaments generally of the metallic type in the case of tyres for industrial vehicles which carry heavy loads.

The belt is made up of various plies or layers of rubber which may or may not be reinforced with reinforcers such as cords or monofilaments, notably of metallic type. It generally comprises at least two superposed belting plies, sometimes referred to as "working plies" or "cross plies", the metallic reinforcing cords of which are arranged parallel to one another within a ply, but are crossed from one ply to the other, which means to say inclined, either symmetrically or otherwise, with respect to the median circumferential plane by an angle which is generally comprised between 10° and 45° depending on the type of tyre in question. These cross plies may be supplemented by various other auxiliary plies or layers of rubber, of widths that vary according to circumstance, and which may or may not contain reinforcers; by way of example, mention may be made of what are known as "protective" plies which have the role of protecting the rest of the belt from external attack, perforation, or even the plies referred to as "hooping plies" which contain reinforciners oriented substantially in the circumferential direction (plies referred to as "zero degree" plies).

It is known that a tyre belt needs to meet numerous, often conflicting, requirements, notably:

- needing to be as rigid as possible for small deformation, because it plays a substantial part in rigidifying the crown of the tyre;
- needing to have the lowest possible hysteresis in order firstly to minimize the heating of the crown internal region during running and secondly to reduce the rolling resistance of the tyre, which goes hand in hand with saving fuel;
- and finally needing to have high endurance, particularly with regard to the phenomenon of separation, cracking of the ends of the cross plies in the shoulder region of the tyre, known by the name of "cleavage", which notably means that the metallic cords that reinforce the belting plies need to have high compression fatigue strength, all of this in a fairly corrosive environment.

The third requirement is particularly important to tyre casings for industrial vehicles such as heavy goods vehicles which are designed to be able to be retreaded one or more times when the treads that they comprise reach a critical level of wear after prolonged running.

The availability of increasingly strong and durable carbon steels means that tyre manufacturers are now, wherever possible, leaning towards the use of cords that have just two layers, in order notably to simplify the manufacture of these cords, reduce the thickness of the composite reinforcing plies and thus the hysteresis of the tyres and ultimately reduce the costs of the tyres themselves and reduce the energy consumption of vehicles fitted with such tyres.

It is also well known that the fatigue-fretting-corrosion endurance of layered cords, particularly in the crown or carcass reinforcements of the tyres, is notably improved by the presence of rubber actually within these cords and opposing the circulation of corrosive agents such as water or oxygen along the empty channels formed by the wires that make up these cords, whether this rubber:

- and this is the most commonplace scenario nowadays, is applied to the inside of the cord later, during the final curing of the tyre that the cord is intended to reinforce, provided that the architecture of this cord, once manufacture is over, is sufficiently aerated and therefore penetrable by rubber;
- or even, and this is even better, is already incorporated into the cord in situ during the very manufacture of the cord, making it possible at the same time to use cords with greater compactness (which are less aerated), something which incidentally is preferable if there is notably a desire to continue to be able notably to reduce the thickness and hysteresis of the rubber plies.

Applications WO 2006/013077, WO 2007/090603, WO 2009/083212, WO 2009/083213, WO 2010/012411, filed by the Applicant companies, have described such two-layer cords of the type rubberized in situ, and the methods of manufacturing them. These cords have the common feature of being rubberized from the inside, while they are actually being manufactured, with a rubber referred to as filling rubber which consists of a compound in the raw (i.e. unvulcanized) state of a diene rubber such as natural rubber.

However, the in-situ rubberizing methods described for the manufacture of these cords, and the cords derived therefrom, are not without their disadvantages.

If it is desirable to be able to guarantee a high level of penetration by the rubber into the cord in order to obtain an air permeability of the cord, along its axis, which is as low as possible then it is necessary, depending on the type of cord and the methods used, to use fairly significant quantities of rubber during the sheathing and this in certain cases may lead to a risk of unwanted overspilling of raw rubber at the periphery of the finished manufactured cord.

Now, because of the high (in this instance, unwanted) stickiness that these diene rubber compounds have in the raw (unvulcanized) state, an accidental overspill, even a very small one, at the periphery of the cords while these are being manufactured may lead to significant inconveniences in the later handling of the cords, particularly during the operations that follow for incorporating the cord into a strip of diene rubber (itself in the raw state) prior to the later operations of manufacturing the tyre and final curing (cross-linking).

Such disadvantages have notably been described in the abovementioned applications WO 2009/083212, WO 2009/083213 and WO 2010/012411. Ultimately, of course, they slow the production rates and have a negative impact on the end cost of the cords and of the tyres that they reinforce.

BRIEF DESCRIPTION OF EMBODIMENTS OF THE INVENTION

Now, in pursuing their research, the Applicant companies have discovered an improved method of manufacture, using a special sheathing rubber that allows the abovementioned disadvantages to be alleviated.

Accordingly, the invention relates to a method of manufacturing a metal cord with two concentric layers (Ci, Ce) of wires, of M+N construction, comprising an internal layer or core (Ci) of M wires, M varying from 1 to 4, and an external layer (Ce) of N wires, of the type "rubberized in situ" that is to say rubberized from the inside, during their actual manufacture, with rubber or a rubber compound, the said method comprising at least the following steps:

- a step of sheathing the internal layer (Ci) with the rubber or the rubber compound, by passing it through an extrusion head;
- a step of assembling the N wires of the external layer (Ce) around the internal layer (Ci) to form the two-layer cord thus rubberized from the inside, and being characterized in that this rubber is an unsaturated thermoplastic elastomer extruded in the molten state.

This method of the invention makes it possible to manufacture, in line and continuously, a cord with two concentric layers which cord, compared with the in-situ rubberized multilayer cords of the prior art, has the notable advantage that the rubber used as filling rubber is an elastomer of the thermoplastic elastomer type rather now than a diene rubber, which by definition is a hot melt elastomer and therefore easier to work, the quantity of which can be easily controlled; thus it is possible, by altering the temperature at which the thermoplastic elastomer is worked, to distribute it uniformly into each of the gaps of the cord, giving this cord optimal impermeability along its longitudinal axis.

Furthermore, the above thermoplastic elastomer does not present any problem of unwanted stickiness in the event of a slight overspill to the outside of the cord after it has been manufactured. Finally, the unsaturated and therefore (co) vulcanizable nature of this unsaturated thermoplastic elastomer makes the cord extremely compatible with the matrices of unsaturated diene rubbers, such as natural rubber, usually used as calendering rubber in the metallic fabrics intended for reinforcing tyres.

BRIEF DESCRIPTION OF THE DRAWINGS

The invention and the advantages thereof will be readily understood in the light of the description and of the exemplary embodiments which follow, and from FIGS. 1 to 3 which relate to these examples and respectively diagrammatically depict:

- an example of a device for twisting and in-situ rubberizing that can be used for the manufacture of a two-layer cord according to a method according to the invention (FIG. 1);
- in cross section, an example of a cord of 3+9 construction of the type with cylindrical layers, rubberized in situ, which can be manufactured using the method of the invention (FIG. 2);
- in cross section, a cord of conventional 3+9 construction, likewise of the type having cylindrical layers, not rubberized in situ (FIG. 3).

I. DETAILED DESCRIPTION OF THE INVENTION

Figure 1:
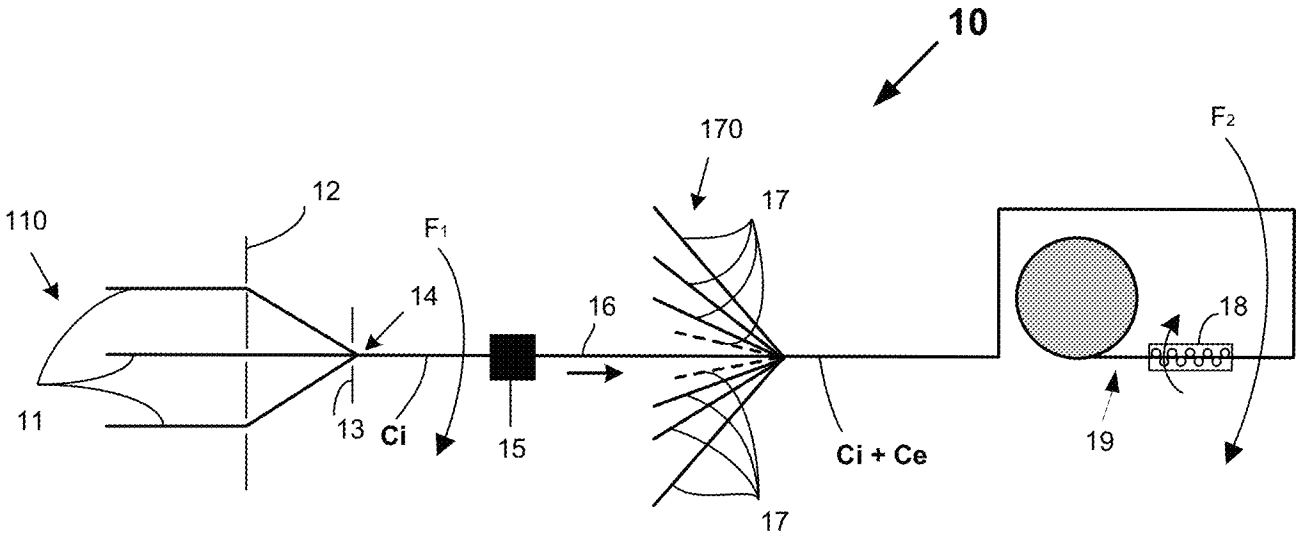

In the present description, unless expressly indicated otherwise, all the percentages (%) indicated are percentages by weight.

Moreover, any range of values denoted by the expression "between a and b" represents the range of values extending from more than a to less than b (i.e. excluding the end points a and b), whereas any range of values denoted by the expression "from a to be" means the range of values extending from a up to b (i.e. including the strict end points a and b).

The method of the invention is therefore intended for the manufacture of a metal cord with two concentric layers of wires, comprising an internal layer or core (Ci) of M wires (M varying from 1 to 4) and an external layer (Ce) of N wires, of the type "rubberized in situ" that is to say rubberized from the inside, during their actual manufacture, with rubber or a rubber compound, (referred to as "filling rubber"), the said method comprising at least the following steps:

- at least a step of sheathing the internal layer (Ci) with the said rubber or the said rubber compound, by passing it through an extrusion head;
- a step of assembling the N wires of the external layer (Ce) around the internal layer (Ci) to form the multilayer cord thus rubberized from the inside, and being characterized in that the said rubber is an unsaturated thermoplastic elastomer extruded in the molten state.

Of course, when the internal layer comprises several (2, 3 or 4) wires, it should be understood that this method involves an upstream prior step of assembling (for example by twisting or cabling), direction S or Z) these wires together to form the internal layer (Ci) before the step of sheathing it.

In the method of the invention, the rubber referred to as filling rubber is therefore introduced in situ into the cord while it is being manufactured, by sheathing the internal layer, the said sheathing per se being performed in a known way for example by passage through an extrusion head which delivers the filling rubber in the molten state.

It will be recalled here that there are two possible techniques for assembling metal wires:

- either by cabling: in which case the wires undergo no twisting about their own axis, because of a synchronous rotation before and after the assembling point;
- or by twisting: in which case the wires undergo both a collective twist and an individual twist about their own axis, thereby generating an untwisting torque on each of the wires and on the cord itself.

Both of the above techniques are applicable, although use is preferably made of a twisting step for each of the above assembling steps.

According to another preferred embodiment, when the internal layer comprises several wires (M other than 1), each step of assembling the wires of the internal layer on the one hand and of the external layer on the other is performed by twisting.

When M is other than 1 (i.e. is equal to 2, 3 or 4), according to another more preferable embodiment, the N wires of the external layer (Ce) are wound in a helix at the same pitch and in the same direction of twisting as the M wires of the internal layer (Ci) so as to manufacture a cord with two layers of the compact type (i.e. with compact layers).

According to another more preferred embodiment, still when M is other than 1, the M wires of the internal layer and the N wires of the external layer are wound in a helix:

either at a different pitch;

or in an opposite direction of twisting;

or at a different pitch and in the opposite direction of twisting, so as to manufacture a two-layer cord of the cylindrical type (i.e. with cylindrical layers).

The extrusion head is raised to a suitable temperature, easily adjustable to suit the specific nature of the TPE used and its thermal properties. For preference, the extrusion temperature for the unsaturated TPE is comprised between 100° C. and 250° C., more preferably between 150° C. and 200° C. Typically, the extrusion head defines a sheathing zone which, for example, has the shape of a cylinder of revolution the diameter of which is preferably comprised between 0.15 mm and 1.2 mm, more preferably between 0.20 and 1.0 mm, and the length of which is preferably comprised between 1 and 10 mm.

The amount of filling rubber delivered by the extrusion head is adjusted in a preferred range comprised between 5 and 40 mg per gram of final cord (i.e. finished manufactured cord rubberized in situ). Below the indicated minimum, it is more difficult to guarantee that the filling rubber will be present, at least in part, in each of the gaps or capillaries of the cord, whereas above the indicated maximum, the cord is exposed to a risk of excessive overspill of the filling rubber at the periphery of the cord. For all of these reasons it is preferable for the quantity of filling rubber delivered to be comprised between 5 and 35 mg, notably between 5 and 30 mg per gram of cord.

The unsaturated thermoplastic elastomer in the molten state thus covers the internal layer (Ci) via the sheathing head, at a rate of progress typically of a few meters to a few tens of m/min, for an extrusion pump flow rate typically of several $cm^3$/min to several tens of $cm^3$/min. The wire or wires of the internal layer, as applicable, are advantageously preheated before they pass through the extrusion head, for example by passing them through an HF generator or through a heating tunnel.

The internal layer or core once sheathed in this way is preferably covered with a minimum thickness of unsaturated TPE which is greater than 5 μm, and typically comprised between 5 and 30 μm.

The N wires of the external layer are then cabled or twisted together (direction S or Z) around the internal layer to form the two-layer cord thus rubberized from the inside. During this final assembly, the wires of the external layer press against the filling rubber in the molten state and become embedded therein. The filling rubber, as it moves under the pressure applied by these external wires, then has a natural tendency to penetrate each of the gaps or cavities left empty by the wires between the external layer and the internal layer adjacent to it.

For preference, all the steps of the method of the invention are performed in line and continuously whatever the type of cord manufactured (compact cord or cylindrical layered cord), and all of this at high speed. The above method can be carried out at a speed (rate of travel of the cord down the production line) in excess of 50 m/min, preferably in excess of 70 m/min, notably in excess of 100 m/min.

However, it is of course also possible to manufacture the cord according to the invention discontinuously, for example in this case by first of all sheathing the internal layer (Ci) then solidifying the filling rubber then spooling and storing this layer prior to the final operation of assembling the external layer (Ce); solidifying the elastomer sheath is easy, it can be performed by any appropriate cooling means, for example by air cooling or water cooling, followed in the latter instance by a drying operation.

At this stage, manufacture of the cord according to the invention is complete. However, when, according to a preferred embodiment of the invention, the two layers of the cord are assembled by twisting, it is then preferable to add a twist balancing step in order to obtain a cord that is said to be twist balanced (or stabilized); "twist balancing" here in the known way means the cancelling out of residual twisting torque (or untwisting spring back) exerted on the cord. The twist balancing tools are well known to those skilled in the art of twisting; they may for example consist of straighteners and/or twisters and/or of twister-straighteners consisting either of pulleys in the case of twisters or small-diameter rollers in the case of straighteners, through which pulleys and/or rollers the cord runs.

For preference, in this completed cord, the thickness of filling rubber between two adjacent wires of the cord, whatever they may be, varies from 1 to 10 μm. This cord can be wound onto a receiving spool, for storage, before being treated, for example, through a calendering installation, in order to prepare a metal/diene rubber composite fabric that can be used for example as a tyre carcass reinforcement or alternatively as a tyre crown reinforcement.

The multilayer metal cord obtained according to the method of the invention can be qualified as a cord that is rubberized in situ, i.e. rubberized from the inside, during its actual manufacture, with rubber or a rubber compound referred to as a filling rubber.

In other words, in the as-manufactured state, most or preferably all of its "capillaries" or "gaps" (the two terms which are interchangeable denoting the free empty spaces formed by adjacent wires in the absence of filling rubber) already contain a special rubber by way of filling rubber which at least partially fills the said gaps, continuously or discontinuously along the axis of the cord. What is meant by the as-manufactured cord is of course a cord which has not yet been brought into contact with a diene rubber (e.g. natural rubber) matrix of a semi-finished product or of a finished article made of rubber, such as a tyre, that the said cord would be subsequently intended to reinforce.

This special rubber is an unsaturated thermoplastic elastomer, used alone or with possible additives (i.e. in this case in the form of an unsaturated thermoplastic elastomer composition) to constitute the filling rubber.

It will be recalled first of all here that thermoplastic elastomers (TPE for short) are thermoplastic elastomers in the form of block copolymers based on thermoplastic blocks. Having a structure that is somewhere between that of a thermoplastic polymer and that of a thermoplastic elastomer, they are made up in the known way of rigid thermoplastic, notably polystrene, sequences connected by flexible elastomer sequences, for example polybutadiene or polyisoprene sequences in the case of unsaturated TPEs or poly (ethylene/butylene) sequences in the case of saturated TPEs.

This is why, in the known way, the above TPE block copolymers are generally characterized by the presence of two glass transition peaks, the first peak (the lower, generally negative temperature) relating to the elastomer sequence of the TPE copolymer and the second peak (the positive, higher, temperature typically above 80° C. for preferred elastomers of the TPS type) relating to the thermoplastic (for example styrene block) part of the TPE copolymer.

These TPEs are often three-block elastomers with two rigid segments connected by one flexible segment. The rigid and flexible segments can be positioned linearly, or in a star or branched configuration. These TPEs may also be two-block elastomers with one single rigid segment connected to a flexible segment. Typically, each of these segments or blocks comprises a minimum of more than 5, generally more than 10, base units (for example, styrene units and isoprene units for a styrene/isoprene/styrene block copolymer).

Such reminders having been given, one essential feature of the TPE used in the method of the invention is that it is unsaturated. An unsaturated TPE by definition and as is well known means a TPE that has ethylene unsaturations, i.e. that contains (conjugated or unconjugated) carbon-carbon double bonds; conversely, a TPE said to be saturated is of course a TPE that has no such double bonds.

The unsaturated nature of the unsaturated TPE means that the latter is (co)crosslinkable, (co)vulcanizable with sulphur, making it advantageously compatible with the unsaturated diene rubber matrices, such as those based on natural rubber, which are habitually used as calendering rubber in the metal fabrics intended for reinforcing tyres. Thus, any overspill of the filling rubber to the outside of the cord, during the manufacture thereof, will not be detrimental to its subsequent adhesion to the calendering rubber of the said metallic fabric, as this defect can be corrected during final curing of the tyre by the possibility of co-crosslinking between the unsaturated TPE and the diene elastomer of the calendering rubber.

For preference, the unsaturated TPE is a styrene thermoplastic elastomer (TPS for short), i.e. one which, by way of thermoplastic blocks, comprises styrene (polystyrene) blocks.

More preferably, the unsaturated TPS elastomer is a copolymer comprising polystyrene blocks (i.e. blocks formed of polymerized styrene monomer) and polydiene blocks (i.e. blocks formed of polymerized diene monomer), preferably of the latter polyisoprene blocks and/or polybutadiene blocks.

Polydiene blocks, notably polyisoprene and polybutadiene blocks, also by extension in this application means statistical diene copolymer blocks, notably of isoprene or of butadiene, such as for example statistical styrene/isoprene (SI) or styrene-butadiene (SB) copolymer blocks, these polydiene blocks being particularly associated with polystrene thermoplastic blocks to constitute the unsaturated TPS elastomers described hereinabove.

A styrene monomer should be understood to mean any monomer based on styrene, substituted or unsubstituted; examples of substituted styrenes may include methyl styrenes (for example o-methylstyrene, m-methylstyrene or p-methylstyrene, alpha-methylstyrene, alpha-2-dimethylstyrene, alpha-4-dimethylstyrene or diphenylethylene), para-tert-butylstyrene, chlorostyrenes (for example o-chlorostyrenes, m-chlorostyrene, p-chlorostyrene, 2,4-dichlorostyrene, 2,6-dichlorostyrene or 2,4,6-trichlorostyrene), bromostyrenes (for example o-bromostyrene, m-bromostyrene, p-bromostyrene, 2,4-dibromostyrene, 2,6-dibromostyrene or 2,4,6-tribromostyrene), fluorostyrenes (for example o-fluorostyrene, m-fluorostyrene, p-flurostyrene, 2,4-difluororstyrene, 2,6-difluorostyrene or 2,4,6-trifluorostyrene), para-hydroxystyrene and blends of such monomers.

A diene monomer is to be understood to mean any monomer bearing two conjugated or unconjugated carbon-carbon double bonds, particularly any conjugated diene monomer having from 4 to 12 carbon atoms selected notably from the group consisting of isoprene, butadiene, 1-methylbutadiene, 2-methylbutadiene, 2,3-dimethyl-1,3-butadiene, 2,4-dimethyl-1,3-butadiene, 1,3-pentadiene, 2-methyl-1,3-pentadiene, 3-methyl-1,3-pentadiene, 4-methyl-1,3-pentadiene, 2,3-dimethyl-1,3-pentadiene, 2,5-dimethyl-1,3-pentadiene, 1,3-hexadiene, 2-methyl-1,3-hexadiene, 3-methyl-1,3-hexadiene, 4-methyl-1,3-hexadiene, 5-methyl-1,3-hexadiene, 2,5-dimethyl-1,3-hexadiene, 2-neopentylbutadiene, 1,3-cyclopentadiene, 1,3-cyclohexadiene, 1-vinyl-1,3-cyclohexadiene, and blends of such monomers.

Such an unsaturated TPS elastomer is selected in particular from the group consisting of styrene/butadiene (SB), styrene/isoprene (SI), styrene/butadiene/butylene (SBB), styrene/butadiene/isoprene (SBI), styrene/butadiene/styrene (SBS), styrene/butadiene/butylene/styrene (SBBS), styrene/isoprene/styrene (SIS), styrene/butadiene/isoprene/styrene (SBIS) block copolymers and mixtures of these copolymers.

More preferably still, this unsaturated TPS elastomer is a copolymer containing at least three blocks, this copolymer being more particularly selected from the group consisting of styrene/butadiene/styrene (SBS), styrene/butadiene/butylene/styrene (SBBS), styrene/isoprene/styrene (SIS), styrene/butadiene/isoprene/styrene (SBIS) block copolymers and mixtures of these copolymers.

According to a particular and preferred embodiment of the invention, the styrene content in the above unsaturated TPS elastomer is comprised between 5 and 50%, for an optimal compromise between thermoplastic properties on the one hand and the (co)crosslinkable nature of this elastomer on the other.

According to another particular and preferred embodiment of the invention, the number-average molecular weight (denoted Mn) of the TPE (notably TPS elastomer) is preferably comprised between 5000 and 500 000 g/mol, more preferably comprised between 7000 and 450 000. The number-average molecular weight (Mn) of the TPS elastomers is determined in the known way, by steric exclusion chromatography (SEC). The sample is firstly dissolved in tetrahydrofuran at a concentration of about 1 g/l and then the solution is filtered through a filter with a porosity of 0.45 μm before injection. The apparatus used is a WATERS Alliance chromatograph. The elution solvent is tetrahydrofuran, the flow rate is 0.7 ml/min, the temperature of the system is 35° C. and the analytical time is 90 min. A set of four Waters columns in series, with the "Styragel" trade names ("HMW7", "HMW6E" and two "HT6E"), is used. The injected volume of the solution of the polymer sample is 100 μl. The detector is a WATERS 2410 differential refractometer and its associated software, for handling the chromatograph data, is the WATERS MILLENIUM system. The calculated average molar masses are relative to a calibration curve produced with polystyrene standards.

According to another particular and preferred embodiment of the invention, the Tg of the unsaturated TPE (notably TPS elastomer) (remember, the first Tg relating to the elastomer sequence) is below 0° C., more particularly below −15° C., this parameter being measured in the known way by DSC (differential scanning calorimetry), for example in accordance with standard ASTM D3418-82.

According to another particular and preferred embodiment of the invention, the Shore A hardness (measured in accordance with ASTM D2240-86) of the unsaturated TPE (notably TPS elastomer) is comprised between 10 and 100, more particularly comprised in a range from 20 to 90.

Unsaturated TPS elastomers such as, for example, SB, SI, SBS, SIS, SBBS or SBIS are well known and commercially available, for example from the company Kraton under the trade name "Kraton D" (e.g., products D1161, D1118, D1116, D1163), from the company Dynasol under the trade name "Calprene" (e.g., products C405, C411, C412), from the company Polimeri Europa under the trade name "Europrene" (e.g., product SOLT166), from the company BASF under the trade name "Styroflex" (e.g., product 2G66), or alternatively from the company Asahi under the trade name "Tuftec" (e.g., product P1500).

The unsaturated thermoplastic elastomer described hereinabove is sufficient on its own for the filling rubber to fully perform its function of plugging the capillaries or gaps of the cord according to the invention. However, various other additives may be added, typically in small quantities (preferably at parts by weight of less than 20 parts, more preferably of less than 10 parts per 100 parts of unsaturated thermoplastic elastomer), these for example including plasticizers, reinforcing fillers such as carbon black or silica, non-reinforcing or inert fillers, laminar fillers, protective agents such as antioxidants or antiozone agents, various other stabilizers, colourants intended for example to colour the filling rubber. The filling rubber could also contain, in a minority fraction by weight with respect to the fraction of unsaturated thermoplastic elastomer, polymers or elastomers other than unsaturated thermoplastic elastomers.

Thanks to the method of the invention, it is possible to manufacture cords which are such that, over any portion of cord of length equal to 2 cm, each gap or capillary of the cord comprises at least one plug of rubber which blocks this capillary or gap in such a way that, in the air permeability test in accordance with paragraph II-1, this cord has a mean air flow rate of less than 2 $cm^3$/min, more preferably of less than 0.2 $cm^3$/min or at most equal to 0.2 $cm^3$/min. Its filling rubber content is preferably comprised between 5 and 40 mg of rubber per g of cord, more preferably comprised between 5 and 35 mg, and notably between 5 and 30 mg.

The term "metal cord" is understood by definition in the present application to mean a cord formed of wires consisting predominantly (i.e. more than 50% by number of these wires) or entirely (100% of the wires) of a metallic material.

Independently of one another and from one layer to the other, the wire(s) of the core (Ci) and the wires of the external layer (Ce) are preferably made of steel, more preferably of carbon steel. However, it is of course possible to use other steels, for example a stainless steel, or other alloys.

When a carbon steel is used, its carbon content (% by weight of steel) is preferably comprised between 0.2% and 1.2%, notably between 0.5% and 1.1%; these contents represent a good compromise between the mechanical properties required for the tyre and the feasibility of the wires. It should be noted that a carbon content of between 0.5% and 0.6% renders such steels finally less expensive as they are easier to draw. Another advantageous embodiment of the invention can also consist, depending on the applications targeted, in using steels having a low carbon content, for example of between 0.2% and 0.5%, due in particular to a lower cost and to a greater ease of drawing.

The metal or the steel used, whether in particular it is a carbon steel or a stainless steel, may itself be coated with a metal layer which, for example, improves the workability of the metal cord and/or of its constituent elements, or the use properties of the cord and/or of the tyre themselves, such as properties of adhesion, corrosion resistance or resistance to aging. According to one preferred embodiment, the steel used is covered with a layer of brass (Zn—Cu alloy) or of zinc; it will be recalled that, during the process of manufacturing the wires, the brass or zinc coating makes the wire easier to draw, and makes the wire adhere to the rubber better. However, the wires could be covered with a thin layer of metal other than brass or zinc having, for example, the function of improving the corrosion resistance of these wires and/or their adhesion to the rubber, for example a thin layer of Co, Ni, Al, of an alloy of two or more of the compounds Cu, Zn, Al, Ni, Co, Sn.

The cords obtained according to the method of the invention are preferably made of carbon steel and have a tensile strength (Rm) preferably higher than 2500 MPa. The total elongation at break (At) of the cord, which is the sum of its structural, elastic and plastic elongations, is preferably greater than 2.0%.

In order to illustrate in greater detail how the invention is implemented for example in the case of a cord with two concentric layers (Ci, Ce) of M+N construction where M is other than 1, comprising an internal layer or core (Ci) made up of M (for example 2 or 3) wire(s) of diameter $d_1$ wound together in a helix at a pitch $p_1$, around which layer are wound together in a helix at a pitch $p_2$, in an external layer (Ce), N wires of diameter $d_2$, the method of the invention therefore comprises at least the following steps:

- first of all, a step of assembling the M core wires (by cabling or twisting) in order to form the internal layer (Ci) at a point referred to as the "assembling point";
- downstream of the said assembling point, a step of sheathing the core with the unsaturated thermoplastic elastomer which is extruded in a molten state by passage through an extrusion head;
- then a step of assembling the N wires of the external layer (Ce) around the internal layer (Ci) (by cabling or twisting) to form the cord thus rubberized from the inside.

Of course, when M is equal to 1, the sheathing step is performed directly on the single core wire.

The M and N wires are delivered by feed means such as spools, distribution grids, which may or may not be coupled to assembling guides, all of which are intended to cause the M wires on the one hand, and the N wires on the other, to converge towards their common twisting points (or assembling points).

M varies from 1 to 4, but the number N of wires can for its part vary to a very large extent depending on the particular embodiment of the invention, it being understood that the maximum number of wires N will be increased if their diameter $d_2$ is reduced in comparison with the diameter $d_1$ of the wires of the layer, so as preferably to keep the external layer in a saturated state.

For preference, N is comprised in a range from 5 to 15. More preferably, the cords manufactured according to the invention have the preferred constructions: 1+6, 2+7, 2+8, 3+8, 3+9, 4+9 and 4+10. Of these cords, those particularly chosen are those made up of wires that have the same diameter from one layer to the other (i.e. $d_1=d_2$).

The core (Ci) of the cord according to the invention is preferably made up of a single individual wire or at most of two or three wires, it being possible for the latter for example to be parallel or on the other hand and for preference twisted together. More preferably still, when M is equal to 1, N is comprised in a range from 5 to 7 and when M is equal to 2 or 3, N is comprised in a range from 6 to 11; when M is equal to 4, N is preferably comprised in a range from 8 to 12.

For an optimized compromise between strength, feasibility, rigidity and flexural endurance of the cord, it is preferable for the diameters ($d_1$ and $d_2$) of the wires of the layers (Ci, Ce), identical or different, to be comprised in a range from 0.08 to 0.50 mm, more preferably in a range from 0.10 to 0.35 mm. Use is preferably made of wires of the same diameter from one layer to the other (i.e. $d_1=d_2$), as this notably simplifies production and reduces the cost of the cords.

It will be recalled here that, as is known, the pitch "p" represents the length, measured parallel to the axis of the cord, after which a wire that has this pitch has made a complete turn around the said axis of the cord.

When the core (Ci) is made up of more than one wire (M greater than 1), the M wires are preferably assembled, notably twisted, at a pitch $p_1$ which is more preferably comprised in a range from 3 to 30 mm, particularly in a range from 3 to 20 mm.

According to another preferred embodiment, the pitches $p_1$ and $p_2$ are equal. This is notably the case for layered cords of the compact type in which the two layers Ci and Ce have the other feature of being wound in the same direction of twisting (S/S or Z/Z). In such "compact" layered cords, the compactness is very high such that the cross section of these cords has a contour which is polygonal rather than cylindrical.

According to another preferred embodiment, the pitches $p_1$ and $p_2$ are different. This is notably the case for cylindrical type layered cords in which the two layers Ci and Ce may be wound in the same direction of twisting (S/S or Z/Z) or in opposite directions (S/Z or Z/S). In such "cylindrical" layered cords, the compactness is such that the cross section of these cords has a contour which is cylindrical, as illustrated by way of example in FIG. 2 (cylindrical 3+9 cord prepared according to the invention).

In the cord prepared according to the invention, the external layer Ce is preferably a saturated layer, i.e. by definition, there is not enough space in this layer for an additional wire of diameter $d_2$, or, in other words, at least one $(N_{max}+1)$th wire of diameter $d_2$, to be added to it, $N_{max}$ representing the maximum number of wires that can be wound in a layer around the central layer (Ci). This construction has the notable advantage of offering higher strength for a given diameter of cord.

As already indicated previously, the cord according to the invention, like all layered cords, may be of two types, namely of the compact layered type or of the cylindrical layered type.

For preference, the layer Ci—in the case where M is greater than 1—and the layer Ce are wound in the same direction of twisting, i.e. either in the S direction ("S/S" arrangement), or in the Z direction ("Z/Z" arrangement). Winding these layers in the same direction advantageously minimizes friction between these two layers and therefore wear on the wires of which they are composed.

According to a more preferred first embodiment, the two layers are wound in the same direction of twisting and at the same pitch (i.e. $p_1=p_2$), in order to obtain a cord of compact type. According to another more preferable embodiment, the two layers are wound in the same direction of twisting and at different pitches (i.e. $p_1 \neq p_2$), in order to obtain a cord of the cylindrical type as depicted for example in FIG. 2.

The method of the invention makes it possible to manufacture cords which, according to a particularly preferred embodiment, may have no, or virtually no, filling rubber at their periphery; what is meant by this that no particle of filling rubber is visible, to the naked eye, at the periphery of the cord, that is to say that a person skilled in the art would, after manufacture, see no difference to the naked eye, from a distance of 3 meters or more, between a spool of cord prepared according to the invention and a spool of conventional cord that has not been rubberized in situ.

However, as indicated previously, any possible overspill of filling rubber at the periphery of the cord will not be detrimental to its later adhesion to a metal fabric calendering rubber thanks to the co-crosslinkable nature of the unsaturated thermoplastic elastomer and of the diene elastomer of the said calendering rubber.

The method of the invention of course applies to the manufacture of cords of the compact type (remember and by definition that these are cords in which the layers are wound at the same pitch and in the same direction) just as it does to the manufacture of cords of the type with cylindrical layers (remember and by definition that these are cords in which the layers are wound either at different pitches (whatever their directions of twisting, identical or otherwise) or in opposite directions (whatever their pitches, identical or different)).

An assembly and rubberizing device that can be used for implementing the method of the above-described method of the invention, applied by way of example to the manufacture of a two-layer cord of 3+N construction, is a device comprising, from upstream to downstream in the direction of travel of a cord as it is being formed:

- feed means for, on the one hand, feeding the three core wires and, on the other hand, feeding the N wires of the external layer (Ce);
- first assembling means for assembling the three wires to manufacture the internal layer (Ci) at a point referred to as the "first assembling point" (these being located between the feed means that feed the three wires and the extrusion means that follow);
- extrusion means delivering the thermoplastic elastomer in the molten state, these being positioned downstream of the first assembling point, for sheathing the core;
- second assembling means for assembling the N wires around the internal layer (Ce) thus sheathed, for the placement of the external layer (Ce) at a point referred to as the "second assembling point".

The attached FIG. 1 shows an example of a twisting assembling device (10), of the type having a rotary feed and a rotary receiver (which are symbolized by two arrows in the same direction $F_1$ and $F_2$), which can be used for the manufacture of a cord having cylindrical layers in which cord the pitches $p_1$ and $p_2$ are different and the directions of twisting of the two layers are the same.

In this device (10), feed means (110) deliver 3 wires (11) through a distribution grid (12) (axisymmetric distributor) which may or may not be coupled to an assembling guide (13), beyond which grid the 3 wires converge on an assembling point (14) in order to form the core (Ci).

The heart (Ci), once formed, then passes through a sheathing zone consisting, for example, of a single extrusion head made up for example of a twin-screw extruder (fed from a hopper containing the TPE in the form of granules) feeding a sizing die via a pump. The distance between the point of convergence (14) and the sheathing point (15) is, for example, comprised between 50 cm and 1 m. The N wires (17) of the external layer (e), of which there are for example 9, delivered by feed means (170) are then assembled by twisting around the heart thus rubberized (16) and continuing in the direction of the arrow. The final (Ci+Ce) cord thus formed is finally collected on the rotary receiver (19) after having passed through twist balancing means (18) which, for example, consist of a straightener and/or twister-straightener.

It will be recalled here that, as is well known to those skilled in the art, in order to manufacture a cord of the type having compact layers (pitches $p_1$ and $p_2$ equal and with the same directions of twisting for the two layers), use would have been made of a device comprising just one rotary (feed or receiver) member, rather than two as described hereinabove (FIG. 1) by way of example.

Figure 2:
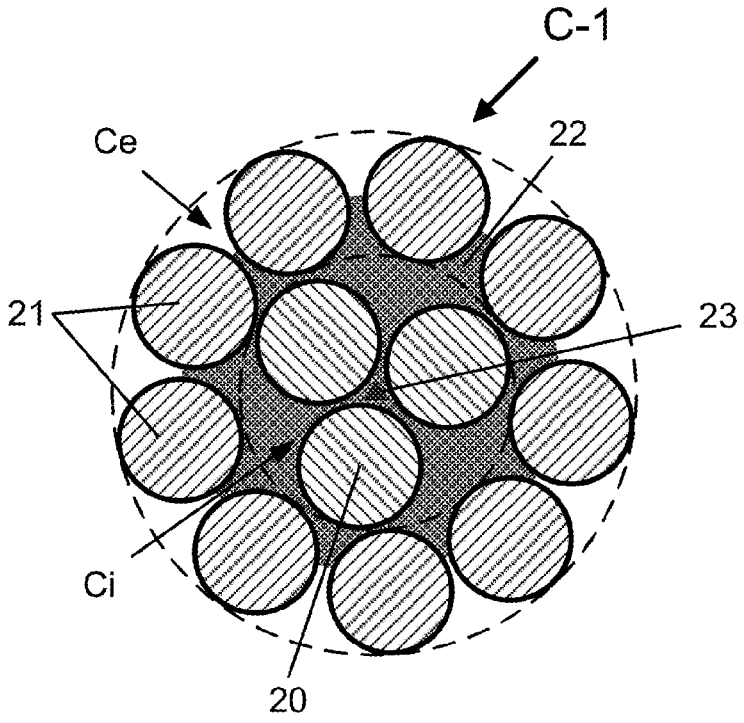

FIG. 2 schematically shows, in section perpendicular to the axis of the cord (which is assumed to be straight and at rest), one example of a preferred 3+9 in-situ rubberized cord that can be obtained using the above-described method according to the invention.

This 3+N cord (denoted C-1) is of the type having cylindrical layers; in this example, its two layers are wound in the same direction (S/S or Z/Z to use the recognized terminology), but at a different pitch ($p_1 \neq p_2$). This type of construction means that its constituent wires (20, 21) form two substantially concentric layers each of which has a contour (E) (depicted in dotted line) which is substantially cylindrical rather than polygonal as in the case of cords with so-called compact layers.

This cord C-1 can be qualified as a cord that is rubberized in situ: each of the capillaries or gaps (spaces that are empty in the absence of filling rubber) formed by the adjacent wires, considered in threes, of its two layers Ci, Ce is filled, at least in part (either continuously or discontinuously along the axis of the cord), with filling rubber such that for any 2 cm length of cord, each capillary comprises at least one plug of rubber.

More specifically, the filling rubber (23) fills each capillary, notably the central capillary (symbolized by a triangle) formed by the adjacent wires. According to a preferred embodiment, the filling rubber extends continuously around the internal layer (Ci) that it covers.

Prepared in this way, the M+N cord can be qualified as airtight: in the air permeability test described in paragraph II-1-B which follows, it is characterized by a mean air flow rate which is preferably less than 2 $cm^3$/min, more preferably less than or at most equal to 0.2 $cm^3$/min.

Figure 3:
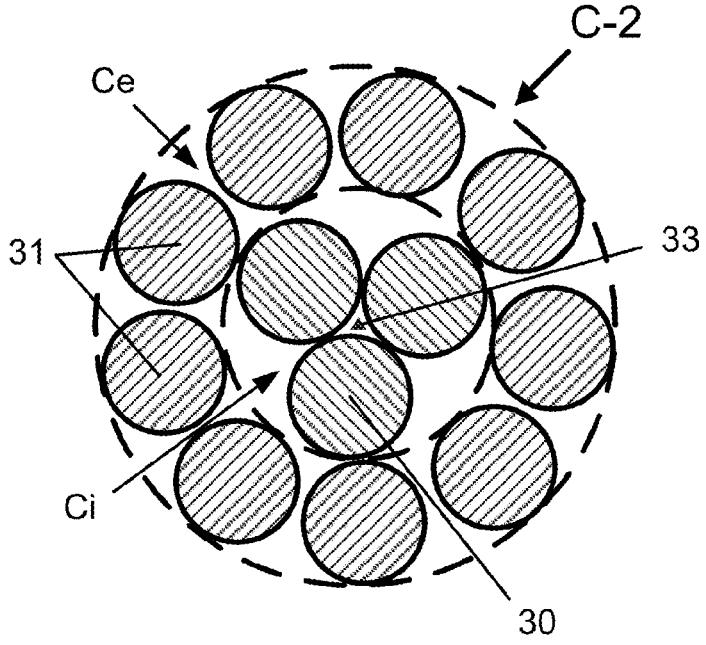

For comparison, FIG. 3 is a reminder of the cross section of a conventional 3+9 cord (denoted C-2) (i.e. one that is not rubberized in situ), likewise of the type having two cylindrical layers including an external layer (Ce) having nine wires (31). The absence of filling rubber means that the three wires (30) of the internal layer (Ci) are practically in contact with one another, leading to an empty and closed central capillary (33) which is impenetrable to rubber from the outside and therefore liable to allow corrosive media to spread.

II. EMBODIMENTS OF THE INVENTION

II-1. Measurements and Tests Used

II-1-A. Dynamometric Measurements

As regards metal wires and cords, force at rupture, denoted Fm (maximum load in N), breaking strength denoted Rm (in MPa) and elongation at break denoted At (total elongation in %) are measured under tension in accordance with standard ISO 6892, 1984.

For the diene rubber compounds, modulus measurements are taken under tension, unless indicated otherwise, in accordance with standard ASTM D 412, 1998 (test specimen "C"): the "true" secant modulus (i.e. the one with respect to the actual cross section of the test specimen) is measured in second elongation (i.e. after an accommodation cycle) at 10% elongation, denoted E10 and expressed in MPa (under standard temperature and humidity conditions in accordance with standard ASTM D 1349 of 1999).

II-1-B. Air Permeability Test

This test makes it possible to determine the longitudinal permeability to air of the cords tested, by measuring the volume of air that passes along a test specimen under constant pressure in a given time. The principle of such a test, which is well known to those skilled in the art, is to demonstrate the effectiveness of the treatment of a cord, at making it impermeable to air; it has been described, for example, in standard ASTM D2692-98.

The test is performed here either on cords that have been extracted from tyres or rubber plies that they reinforce, and have therefore already been coated from the outside with rubber in the cured state, or on as-manufactured cords.

In the latter instance, the raw cords need to be immersed, coated from the outside beforehand using a rubber referred to as coating rubber. For that, a series of 10 cords laid parallel (distance between cords: 20 mm) is placed between two <<skims>> or layers (two rectangles measuring 80×200 mm) of a diene rubber compound in the raw state, each skim having a thickness of 3.5 mm; all of this is then immobilized in a mould, each of the cords being kept under sufficient tension (for example 2 daN) to guarantee that it lies straight as it is being placed in the mould, using clamping modules; it is then vulcanized (cured) for 40 min at a temperature of 140° C. and at a pressure of 15 bar (rectangular piston measuring 80×200 mm) After that, the entity is removed from the mould and ten test specimens of cords thus coated are cut out for characterizing in the shape of parallelepipeds measuring 7×7×20 mm.

The compound used as coating rubber is a rubber conventionally used in tyres, based on natural (peptized) rubber and carbon black N330 (65 phr), also containing the following usual additives: sulphur (7 phr), sulphenamide accelerator (1 phr), ZnO (8 phr), steoric acid (0.7 phr), antioxidant (1.5 phr), cobalt naphthenate (1.5 phr); the E10 modulus of the coating rubber is around 10 MPa.

The test is carried out on a 2 cm length of cord, which is therefore coated with its surrounding rubber compound (or coating rubber) in the cured state, in the following way: air is injected into the inlet end of the cord, at a pressure of 1 bar, and the volume of air at the outlet end is measured using a flow meter (calibrated for example from 0 to 500 $cm^3$/min). During measurement, the test specimen of cord is immobilized in a compressed airtight seal (for example a seal made of dense foam or of rubber) so that only the quantity of air passing along the cord from one end to the other along the longitudinal axis thereof is taken into consideration by the measurement; the airtightness of the seal itself is tested beforehand using a solid rubber test specimen, i.e. one with no cord.

The higher the longitudinal impermeability of the cord, the lower the flow rate measured. As the measurement is taken with a precision of ±0.2 $cm^3$/min, measured values equal to or lower than 0.2 $cm^3$/min are considered to be zero; they correspond to a cord that can be qualified as airtight along its axis (i.e. in its longitudinal direction).

II-1-C. Filling Rubber Content

The quantity of filling rubber is measured as the difference between the weight of the initial cord (therefore rubberized in situ) and the weight of the cord (therefore that of its wires) from which the filling rubber has been removed by treatment in a suitable extraction solvent.

The procedure is for example as follows. A test specimen of cord of given length (for example one meter), coiled on itself to reduce its bulkiness, is placed in a fluidtight bottle containing one liter of toluene. The bottle is then agitated (125 outward/return movements per minute) for 24 hours at room temperature (20° C.) using a "reciprocating shaker" (Fischer Scientific "Ping Pong 400"); after the solvent has been eliminated, the operation is repeated once. The cord thus treated is recovered and the residual solvent evaporated under vacuum for 1 hour at 60° C. The cord thus rid of its filling rubber is then weighed. This calculation can be used to deduce the filling rubber content of the cord, expressed in mg (milligrams) of filling rubber per g (gram) of initial cord, and averaged over 10 measurements (i.e. over 10 meters of cord in total).

II-2. Manufacture of the Cords and Tests

In the following tests, two-layer cords of 3+9 construction, made up of fine, brass-coated carbon steel wires, are manufactured.

The carbon steel wires are prepared in a known manner, for example from machine wire (diameter 5 to 6 mm) which is first of all work hardened, by rolling and/or drawing, down to an intermediate diameter of around 1 mm. The steel used is a known carbon steel (of the NT type, standing for "Normal Tensile") with a carbon content of around 0.7%, the rest consisting of iron and the usual inevitable impurities associated with the steel manufacturing process. The wires of intermediate diameter undergo a degreasing and/or pickling treatment prior to their subsequent conversion. After a brass coating has been applied to these intermediate wires, what is known as a "final" work-hardening operation is carried out on each wire (i.e. after the final patenting heat treatment) by cold drawing in a wet medium with a drawing lubricant for example in the form of an aqueous emulsion or an aqueous dispersion.

The steel wires thus drawn have the following diameters and mechanical properties:

TABLE 1

| Steel | Φ (mm) | Fm (N) | Rm (MPa) |
|---|---|---|---|
| NT | 0.23 | 114 | 2800 |

These wires are then assembled in the form of 3+9 two-layered cords the mechanical properties of which are given in table 2.

TABLE 2

| Cord | $p_1$ (mm) | $p_2$ (mm) | Fm (daN) | At (%) |
|---|---|---|---|---|
| C-1 | 6.3 | 12.6 | 131 | 2.2 |

The 3+9 cord (C−1) according to the invention, as depicted schematically in FIG. 2, is formed of 12 wires in total, all of diameter 0.23 mm, which have been wound at two different pitches ($p_1 \neq p_2$) and in the same direction of twisting (S) in order to obtain a cord of the cylindrical layered type. The content of filling rubber (22), measured using the method indicated above at paragraph I-3, is 23 mg per g of cord. This filling rubber fills the central channel or capillary (23) formed by the three heart wires (20) separating them slightly, while at the same time completely covering the internal layer Ci formed by the three wires. It also fills, at least in part if not preferably completely, each of the other gaps or capillaries formed by the wires of the two layers (Ci, Ce).

To manufacture this cord, use was made of a device as described hereinabove and schematically depicted in FIG. 1. The filling rubber consisted of an unsaturated TPS elastomer (in this instance an SBS elastomer with a Shore A hardness of around 70) which was extruded at a temperature of around 180° C., using a twin-screw extruder (length 960 mm, L/D=40) feeding a sizing die of diameter 0.515 mm via a pump, the internal layer Ci moving, while it was being sheathed, at right angles to the direction of extrusion and in a straight line.

The cords C-1 thus manufactured were then subjected to the air permeability test described at paragraph II-1, by measuring the volume of air (in $cm^3$) passing along the cords in one minute (averaged over 10 measurements for each cord tested).

For each cord C-1 tested and for 100% of the measurements (i.e. ten test specimens out of ten), a flow rate of zero or less than 0.2 $cm^3$/min was measured; in other words, the cords prepared according to the method of the invention can be termed airtight along their longitudinal axis.

In conclusion, the cords prepared according to the method according to the invention therefore exhibit an optimal degree of penetration by the unsaturated thermoplastic elastomer, with a controlled amount of filling rubber guaranteeing that internal partitions (continuous or discontinuous along the axis of the cord) or plugs of rubber will be present in the capillaries or gaps in sufficient number; thus, the cord becomes impervious to the spread, along the cord, of any corrosive fluid such as water or oxygen in the air, thus eliminating the wicking effect described in the introduction to this text.

Furthermore, the thermoplastic elastomer used presents no problems of unwanted stickiness in the event of a slight overspill on the outside of the cord after it has been manufactured by virtue of its nature that is unsaturated and therefore (co)vulcanizable with a matrix of unsaturated diene rubber such as natural rubber.

The invention claimed is:

1. A method of manufacturing a metal cord that includes two concentric layers of wires having an M+N construction, the cord being rubberized in situ from within or inside during manufacture of the cord, the method comprising steps of:

sheathing an internal layer with rubber or a rubber compound by passing the internal layer through an extrusion head, the internal layer including M wires, with M having a value in a range from 1 to 4; and assembling an external layer of N wires around the internal layer to form a two-layer cord that is rubberized from within or inside, wherein the rubber or the rubber compound includes an unsaturated thermoplastic elastomer and is extruded in a molten state.

2. The method according to claim 1, wherein the unsaturated thermoplastic elastomer is an unsaturated styrene thermoplastic elastomer.

3. The method according to claim 2, wherein the unsaturated styrene thermoplastic elastomer includes polystyrene blocks and polydiene blocks.

4. The method according to claim 3, wherein the polydiene blocks are selected from a group of blocks consisting of polyisoprene blocks, polybutadiene blocks, and mixtures thereof.

5. The method according to claim 4, wherein the unsaturated styrene thermoplastic elastomer is a copolymer selected from a group of copolymers consisting of styrene/butadiene/styrene copolymers, styrene/butadiene/butylene/styrene copolymers, styrene/isoprene/styrene copolymers, styrene/butadiene/isoprene/styrene block copolymers, and mixtures thereof.

6. The method according to claim 1, wherein a temperature at which the thermoplastic elastomer is extruded is between 100° C. and 250° C.

7. The method according to claim 1, wherein the internal layer includes more than one wire (M>1), and wherein the N wires of the external layer are wound in a helix at a same pitch and in a same direction of twisting as the M wires of the internal layer, such that the layers of the cord are manufactured to be compact layers.

8. The method according to claim 1, wherein the internal layer includes more than one wire (M>1), wherein the M wires of the internal layer and the N wires of the external layer are wound in helixes at different pitches, or in opposite directions of twisting, or both, and wherein the layers of the cord are cylindrical layers.

9. The method according to claim 1, wherein the step of assembling includes twisting the N wires of the external layer, and wherein, if M is greater than 1, the step of assembling includes twisting the M wires of the internal layer.

10. The method according to claim 9, further comprising a step of, after the step of assembling, twist balancing by passing the cord through a twist balancer.

* * * * *